United States Patent [19]

Watanabe et al.

[11] 4,287,283

[45] Sep. 1, 1981

[54] IRON POWDER DEVELOPING CARRIER AND THE MANUFACTURING METHOD OF THE SAME, DEVELOPER CONTAINING SAID CARRIER AND METHOD OF FORMING VISIBLE IMAGE BY USING SAID DEVELOPER

[75] Inventors: Shotaro Watanabe, Machida; Makoto Tomono, Hino; Goichi Yamakawa, Hachioji; Takeo Nishimura, Kawaguchi; Nobuo Takahashi, Tokyo, all of Japan

[73] Assignee: Konishiroku Photo Industry Co., Ltd., Tokyo, Japan

[21] Appl. No.: 882,101

[22] Filed: Feb. 28, 1978

[30] Foreign Application Priority Data

Mar. 9, 1977 [JP] Japan ..... 52-25553

[51] Int. Cl.[3] ..... G03G 9/10

[52] U.S. Cl. ..... 430/108; 430/137; 148/6.35; 148/20.3

[58] Field of Search ..... 252/62.1 P, 62.1 M; 96/150; 427/216; 430/108, 137; 148/105, 126, 14, 20.3, 6.35

[56] References Cited

U.S. PATENT DOCUMENTS

| | | | |
|---|---|---|---|
| Re. 27,912 | 2/1974 | Millu | 252/62.1 P |
| 2,874,063 | 2/1957 | Greig | 252/62.1 P |
| 2,890,968 | 6/1959 | Giaimo, Jr. | 252/62.1 |
| 3,718,594 | 2/1973 | Millu | 252/62.1 P |
| 3,795,618 | 3/1974 | Kasper | 430/108 |
| 3,849,182 | 11/1974 | Hagenbach | 252/62.1 P |

*Primary Examiner*—John D. Welsh

*Attorney, Agent, or Firm*—James E. Nilles

[57] ABSTRACT

An iron powder developing carrier for developing an electrostatic latent image, a manufacturing method thereof, a developer containing said developing carrier and a method of forming a visible image by using said developer.

Said iron powder developing carrier has the apparent density from 1.5 to 2.5. Said manufacturing method comprises the steps of sintering a raw iron powder having been ground to particles of not larger than 50 microns in diameter without using any binder agent at the temperature from 900° to 1200° C. to form an sintered body, grinding and classifying said sintered body into an intermediate iron powder having the particle diameter from 50 to 200 microns, then treating said intermediate iron powder to oxidize at the temperature from 280° to 390° C., and adjusting the resultant iron powder so as to have the apparent density from 1.5 to 2.5.

2 Claims, No Drawings

IRON POWDER DEVELOPING CARRIER AND THE MANUFACTURING METHOD OF THE SAME, DEVELOPER CONTAINING SAID CARRIER AND METHOD OF FORMING VISIBLE IMAGE BY USING SAID DEVELOPER

This invention relates to an iron powder developing carrier for developing an electrostatic latent image, a manufacturing method thereof, as well as a developer containing said developing carrier and a method of forming a visible image, and more particularly it relates to the developer suitable for developing the electrostatic latent image formed on a transfer type electrophotographic photosensitive plate having a photoconductive element and the method of forming the visible image.

In an electrophotography, a surface charge is charged uniformly in the dark room on a photosensitive plate having a photoconductive element, and then an active light of a certain pattern is exposed on said plate, so that the surface charge thereof is eliminated corresponding to a relative energy of said light pattern, consequently a partially different surface charge, namely the electrostatic latent image corresponding to the light pattern is formed. Then, the surface of the photosensitive plate having the electrostatic latent image is contacted with a suitable developer so that a visible image is formed. Developing systems of the electrostatic latent image are classified roughly into the following two systems; a liquid developing system using a developer in which various kinds of a pigment and a dye are dispersed finely in an insulating organic liquid; a so-called dry developing system such as a fur brush method, an impression method or a powder cloud method wherein a fine powder developer consisting of a toner containing a coloring agent such as a carbon black dispersedly in a natural or synthetic resin is used, or a magnetic brush method, a cascade method etc. wherein the developer containing a toner and a developer carrier such as an iron powder and glass beads etc. is used. When an electrostatic latent image on a photosensitive plate is developed by aforesaid system, the toner contained in the developer is deposited according to either a desired charge pattern or a discharge pattern, therefore a toner image is formed. Said toner image is then fixed permanently on a photosensitive plate by a heat, pressure or solvent vapor, or said toner image is transferred on a second element such as a paper and is then fixed permanently by the identical method. In the latter transferring method, the photosensitive plate is utilized repeatedly for forming the electrostatic latent image. In said transferring method, either a photosensitive plate having a photoconductive layer in which selenium or selenium alloy is evaporated on a substrate or a photosensitive plate having a photoconductive layer in which photoconductive zinc oxide particles are dispersed in a binding material, is utilized.

Thus formed electrostatic latent image is developed mainly by the magnetic brush method or by the cascade method of said dry developing systems.

In the magnetic brush method, a non-magnetic rotary sleeve inside of which a magnet is fixed is utilized for developing. Said rotary sleeve is arranged likely to contact with the developer during the rotation thereof, either by dipping a part of surface thereof in a developer supplying source, or by any other method, and a powder developer consisting of the developing carrier and the toner is attracted magnetically to the surface of said sleeve. When said developer has been arrived to an working area of magnetic force of said magnet fixed in said sleeve, particles of the developer are arranged to form a bristle brush shape. Said bristle tends to coincide to the direction of magnetic flux, consequently it stands upright around the magnetic pole of said magnet, while it lies down almost horizontally at an outside of working area of said magnetic pole. During one cycle of the continuously rotating sleeve, said developer is attracted to said sleeve from the supplying source thereof before developing and a part or all of said developer is returned after developing to said supplying source, so that in said operating method, a fresh developer is always supplied to the contacting place of said brush with the surface of a photosensitive plate having the electrostatic latent image. In a typical copy cycle, said sleeve pass through a series of the following processes: the developer is attracted, the bristle brush is formed, said brush contacts with the electrostatic latent image, then said brush is collapsed and said developer is released. In the cascade method, the powder developer consisting of the developing carrier and the toner is cascaded on the surface of the photosensitive plate having the electrostatic latent image in order to contact thereto for developing.

In both of the magnetic brush method and the cascade method, the developer of a two component system consisting of the developing carrier and the toner is used. Said developer is a mixture of the toner of fine particles and the developing carrier of relatively coarse particles, and the particle size of the developing carrier in the case of the magnetic brush method, for example, is from 50 to 200 microns in diameter, and is from 200 to 700 microns in diameter in case of the cascade method. In case of the magnetic brush method, said magnetic materials as iron, nickel or cobalt etc. or materials coated with a resin film on the surface thereof, and in case of the cascade method, silica sand, glass beads or steel balls, or materials coated with the resin film on the surface thereof are used as the material of the developing carrier. Generally used toner has a diameter of from 1 to 50 microns and said toner consists essentially of a natural or synthetic resin, a pigment such as carbon black or dye such as a nigrosine dye, and if necessary a charge controlling agent, a releasing agent for preventing an offset phenomenon of the toner to be arisen on a hot roller during the fixing process.

The role of the developing carrier in the developer is to give a correct friction charging polarity and the suitable charge to the toner in order that the toner is attracted to the electrostatic latent image preferentially and selectively, and to develop said image portion in high density, in addition, to attract again electrostaticly and remove the toner deposited on a non-image portion (a background portion) for obtaining the clear copy. If the charge of the toner is low during the developing process, such a drawback is arisen that although the image portion is in high density, background portion is also in high density, so that a so-called background development is high and the resolving power is worse. If the charge of the toner is high during the developing process, the background development is low and the resolving power is better but such a drawback arises that the image portion is not in sufficient density. Since the charge of the toner decides the quality of the image to be obtained as abovementioned, it is very important for the developing to control said charge at the desired value.

Heretofore, methods for controlling the charge of the toner as uniform and regular as possible by the selection of kind and the adjustment of adding quantity of the pigment and the dye to be contained in the toner have been tried. Trials have also been made, wherein the friction charging ability is controlled by improving the resin component contained in the toner, or the manufacturing condition of the toner for improving and stabilizing the dispersion of various ingredients to be added in the toner is studied. A trial to improve the property of the developing carrier has also been made because the satisfactory result can not necessarily be obtained by trying to control the friction charging ability of the toner only from the toner side. For example, a method has been utilized, wherein a resin so prepared is coated on the surface of particles of the developing carrier as to have the adhesion with the surface of the developing carrier, to be as non-adhesive as possible against the toner also superior in the wear-resistance and to have the uniform and suitable friction charging ability with the toner. Ethyl cellulose, polyamide, polymethyl methacrylate, polyethylene trifluoride, polyethylene tetrafluoride or a nitrocellulose etc., for example, is used for said resin.

On the other hand, the developing method has also been improved for obtaining the good copy quality. A developing method, for example, has been proposed, wherein a developing electrode is arranged during the developing process on which a bias voltage is applied. By applying said bias voltage an electric force of the electrostatic latent image formed on the photosensitive plate is controlled efficiently through the developing carrier having a suitable electric resistance for the developing by which the good quality image as well as a copy image of a high-speed transfer type can be obtained. Aforesaid bias voltage can be applied on the developing electrode in both developing methods of the magnetic brush method and the cascade method. However, the weakest point of the developing system using said bias voltage is that the developer is deteriorated fast. For example, said developer lasts only about 1/10 of a time if compared with the developer used without applying bias voltage. The reason for the above is that an effective value of the bias voltage varies along with the variation of resistance and the depreciation of developing ability of the developing carrier in a repeated use, consequently the toner becomes hard to develop the photosensitive material hence the copy density depreciates. In other words, the variation of an effective value of the bias voltage itself resulted from the deterioration of the developing carrier remarkably brings the deterioration of the developer.

The deterioration of the developer originates generally in both of the toner and the developing carrier. The deterioration of the developer originated in the toner is so caused, for example, that the toner is deposited on the surface of the developing carrier by the poor dispersion of ingredients such as the pigment and the dye etc. contained in the toner, or the resin component in the toner is broken into fine powder so that it contaminates the surface of the developing carrier, thereby gives a bad influence to the friction charging ability. Said deterioration of the toner as above increases, as a result, the apparent electric resistance of the developing carrier, reduces an effective value of the bias voltage and causes the background development. The abovementioned deterioration of the developer originated in the toner can be improved by the selection of ingredient structure or the manufacturing condition of the toner.

In the developing system in which the bias voltage is applied on the developing electrode, it is required that the developing carrier has the electric resistance of the suitable value for preventing the electrostatic leak of the electrostatic latent image, hence the iron powder developing carrier is mainly utilized. However, the iron powder developing carrier has a drawback such that its friction charging ability with the toner is unstabilized and tends to cause the background development. Namely, the iron powder developing carrier tends to increase the electric resistance thereof gradually along with the copies, as a result, an effective value of the bias voltage is decreased and the backbround development is produced. In order to improve said drawback of the iron powder developing carrier, a method has been proposed, wherein the surface of the iron powder is oxidized so that an oxidized film is formed. The iron powder developing carrier treated as above has the more stabilized electric resistance compared with the iron powder developing carrier whose surface has not been oxidized, and the developer containing it has a longer life, more durability and less background development. In order to obtain the iron powder developing carrier having the desired electric resistance by oxidizing the surface thereof, however, a considerablly complicated treating process has been required heretofore and the controlling thereof is very difficult. In the method described in U.S. Pat. No. 3,767,477, for instance, five stage operations are required under the strict restriction of conditions such as the oxidizing atmosphere and the temperature ect., so that such operations are very troublesome, and the control to obtain the desired developing ability is very difficult. And yet, the property of the iron powder developing carrier obtained by the aforesaid method is not necessarily satisfactory. Although it is true that the developer containing the iron powder developing carrier having the oxidized film is superior to be used repeatedly in the continuous and high-speed transfer type developing when being compared with the developer containing the iron powder developing carrier not having the oxidized film, it still has a drawback that the variation of electric resistance of the iron powder developing carrier is large and the friction charging ability with the toner is unstabilized so that the developing density is reduced and background development is produced. Namely, when the electrostatic latent image formed on the electrophotographic photosensitive plate is developed by applying bias voltage on the developing electrode in the continuous and high-speed transfer type, the deterioration of the developing carrier is multiplied by the deterioration of the toner as well as the variation of memory, namely the deterioration of the photosensitive plate caused by the repeated copies, so that the developing ability is reduced rapidly, the sufficient density can not be obtained on the copy and the background development is produced, hence the life and durability of the developer is insufficient for obtaining a large number of copies continuously and highspeededly. In a copying apparatus for copying in the high-speed transfer type, a method is being generally adopted, wherein a transfer paper is separated mechanically from the photosensitive plate by using a separating claw etc. when a developer toner is transferred electrostaticly on the transfer paper, but in such a separating method as above, there is a tendency that the sensitivity of a portion of the photosensitive plate is reduced due to the pressure of the separating claw, and the background development is produced on said portion as a result of said reduction of sensitivity, in addition, there is a problem that said background development tends to be remarkably stressed particularly when the developing ability has depreciated. The prior method in which the electrostatic latent image is developed by applying said developer having the iron powder developing carrier, particularly in the high-speed transfer type in which a bias voltage is applied on the developing electrode, has not been satisfactory for a practical operation.

In the meantime, various trials have been made recently for the purpose of improving the developing ability of the developer. For example, an improvement of a metal powder developing carrier to be used in the developer is laid open in Japanese Patent Laid-open Publication No. 15,537/73. Said developing carrier is so manufactured that a fine powder such as iron or nickel etc. is mixed with a solution in which an inorganic substance such as sodium silicate etc. or a polystyrene, acrylic alkyl ester, vinyl chloride etc., or polyvinyl alcohol is dissolved in a solvent, the resultant mixture is pelletized and dried at the temperature around 125° C., and is further more sintered, in case the inorganic substance is utilized as the binding material, at the temperature range from 1250° to 1300° C. so that the developing carrier is made likely to a bead state. It is pointed out in said publication that the developing carrier made as above improves the friction charging ability, and the durability thereof and the copy quality when it is used as the developer.

However, the developing carrier described in said publication has various weak points generally that it is coated with an insulating binding material so that it is difficult to obtain a desirable electric ability, in addition, an insufficiently coated portion with the binding material is naturally eroded during the application when the iron powder is utilized as the material of the developing carrier, consequently the ability of the developing carrier is depreciated. Under the circumstances, the developer using said carrier having the truly desirable developing ability have long been demanded.

One object of the present invention is to provide a developing carrier which is capable to stabilize the friction charging ability with the toner, to improve the characteristic of the developer and to extend the durability of the developer remarkably.

Another object of the present invention is to provide a developer consisting of a developing carrier, and a toner which are superior in the friction charging ability and the developing ability and are capable to form an excellent visible image having the high density and less background development, as well as the method of forming the visible image using said developer.

A further object of the present invention is to provide a developer which is capable to form a clear visible image with the high density when a large number of copying is made in the high-speed transfer type using the developing electrode, as well as a method of forming the visible image using said developer.

Inventors of the present invention found it out that the aforesaid objects can be accomplished by a developer as well as the method of forming the electrographic visible image using said developer containing a developing carrier as its ingredient which is an oxidized iron powder having the apparent density from 1.5 to 2.5 and is made by a method, wherein a raw iron powder having been ground to particles of not larger than 50 microns in diameter is sintered without using any binding material at the temperature from 900° to 1200° C. to form a sintered body, the sintered body is ground and classified into a powder of the average particle diameter from 50 to 200 microns, and the resultant powder is then treated to oxidize at the temperature from 280° to 390° C. after being washed and dried, if necessary, by using a water, an organic solvent, a surface activating agent etc. That is to say, the developing carrier used in the present invention is so made, as aforementioned, that a raw iron material is ground to the iron powder having the particle diameter not larger than 50 microns, the iron powder is sintered to form a sintered body, the sintered body is ground into a powder having the average particle diameter from 50 to 200 microns, and is further treated to oxidize after being washed if necessary. Said developing carrier of this invention made by the so extraordinary method as above is superior in the friction charging ability with the toner and durable for repeated copy, and form an excellent visible image in high density and less background development when it is applied as the developer with the toner for the electrophotography.

When a developer having the developing carrier of the present invention and a developing electrode are used and a suitable bias voltage is applied thereto for developing the latent image in the repeated transfer type electrophotography, a superior visible image can be obtained continuously with less background development, because in the process of repeated copying said developer is not effected by the spent toner due to the special construction of the developing carrier particles, the deterioration of the friction charging ability of the developer is little even after a large number of copying is carried out and the bias voltage can be applied effectively.

Although the reason why said superior operation effect is achieved is not obvious, but it is assumed that the internal structure of the developing carrier consisting of the oxidized iron powder made by the abovementioned method is quite different if being compared with the developing carrier of the widely known prior method which is coated with the oxidized iron. Namely, said carrier consists of fine sintered particles, the surface of said carrier is uneven and porous, so that the surface area of particles of the developing carrier coated with the oxidized iron film increases, as the result, the surface of particles of the developing carrier is superior in the electric ability if being compared with the prior developing carrier, hence superior abilities such as the moisture-proof, durability, good friction charging ability and image quality when it is used in the developer are accomplished.

For making the developing carrier used in the present invention firstly, a fine raw iron powder having the particle diameter not larger than 50 microns is prepared by grinding an iron body. If the raw iron powder is larger than the above, the developing carrier having a desired particle structure and the developing ability can not be obtained in the succeeding manufacturing operations, so that the effect can not be expected.

Said iron powder is heated, and sintered at the temperature range from 900° to 1200° C. without using any binding material such as sodium silicate, polystyrene, polyacrylic ester or polyvinyl alcohol, is ground after cooling, and is classified for selecting particles of the diameter range from 50 to 200 microns. The iron powder manufactured as above is then treated to oxidize at the temperature from 280° to 390° C. so that the oxidized film is coated on the surface of the iron powder. Said oxidized film gives a suitable electric resistance to the iron powder, in addition, said iron powder provides the superior friction charging ability with the toner, the moisture-proof, the mechanical and electrical durability and the excellent image quality when it is used as the developing carrier.

It is required that the apparent density of said carrier particles measured by the measuring method (Japanese Industrial Standard (JIS) "Apparent density measuring method of metal powder" Z2504-1966) is within the range from 1.5 to 2.5 g/cm$^3$ in order that said developing carrier manufactured as above accomplishes the objects of this invention.

In said measuring method, the apparent density is so measured that an apparatus consisting of a powder flowing funnel having an orifice of a designated diameter and a cylindrical cup having a depth of 40 mm and the volume of 25±0.05 cm$^3$ for receiving a falling metal powder from said funnel is prepared, and a sufficiently dried metal powder is poured into said cup through said funnel, then the weight in grams of the metal powder having filled up said cup is measured in a balance which is multiplied by 0.04, thereby the apparent density is obtained in g/cm$^3$. Said apparent density varies according to processing operations such as the size of the raw iron powder, the treating temperature of the raw iron powder, a grinding method of the sintered body obtained by the sintering, a classifying degree after the grinding and the like.

Further, the sintered iron powder can be ground by using the roller grinder, the ball mill, impact grinder and the combination thereof. However, in the present invention, it is suitable to grind the sintered iron powder by using the roller grinder or the ball mil.

When the apparent density is larger than 2.5, the surface area of particles of the developing carrier reduces so that the ruggedness (porosity) of the particle surface which is a feature of the developing carrier of the present invention is lost, therefore the surface area of the oxidized iron film also decreases. The superior developing ability and durability can not be accomplished by the above. If the apparent density is less than 1.5 g/cm$^3$, the ruggedness on the particle surface of the developing carrier can be formed but, at the same time, the particle diameter reduces much so that an obstacle is produced that particles of the developing carrier destroy the photosensitive layer surface. The apparent density range from 1.5 to 2.5 g/cm$^3$ is dispensable as above to decide the quality of the developing carrier. For the making developer using said iron powder developing carrier of this invention, from 2 to 15 parts of a toner comprising a resin such as styrene resin, methyacrylic methyl ester resin, polyester resin or epoxy resin, a pigment such as carbon black or phthalocyanine blue, a charge controlling agent such as nigrosine or zaponschwarz X and, if necessary, a developer flowing agent such as silica, metal soap or wax are added to 100 parts of an iron powder developing carrier. Although the developer of this invention is identical to the structure of the publicly known two component system developer, the property of this developing carrier is different from that of the publicly known developer and the latitude of a mixing ratio of the developing carrier with the toner necessary for obtaining a desired image quality is broad. For instance, if from 7 to 10 parts of the toner is added to 100 parts of the developing carrier of the developer in case of the prior arts, it is usual that such developer can not be useful since the background development is produced, on the contrary, the developer of this invention has a virtue that the background development is limited and an image in high density is formed. When the developer having the developing carrier of the present invention is used, no background development in the visible image is arisen and the quality of the visible image is prevented from being lowered even when a large number of copies are made, because a bad influence upon the developer due to the adhesion of the toner to the developing carrier (spent toner), such as the variations of friction charging ability and the effect of the bias voltage is not generated.

The developer of this invention can be applied on not only the electrostatic latent image which is formed on a photoconductive photosensitive body composed of a photoconductive material such as publicly known selenium, titanium oxide, cadmium sulfide or zinc oxide but also the electrostatic latent image formed on an electrostatic recording sheet which has no photosensitivity.

In a method using the developer of this invention, said electroconductive photosensitive plate is corona charged by a corotron or scorotron charger having an electrode such as a tungsten wire, for instance, an electrostatic latent image is formed by exposing, then developed for forming a toner image by the publicly known developing method such as the cascade developing method or the magnetic brush developing method etc. using the developing electrode under the application of the suitable bias voltage, and, if necessary, said toner image is transferred on a transfer paper by using a transfer charger before the toner image is fixed by a fixing device such as a radiating heater, a heat roller or a pressure roller. By being operated as above, an excellent image in high density and less background development can be obtained, and more particularly, the transferred image of excellent quality can be formed for the long range in the repeat transfer type copying method because the weariness of the developer is little due to the superior property of the developing carrier.

Although the present invention will be materially described hereafter according to an embodiment, conditions of embodying this invention are not limited thereto.

EMBODIMENT

Two kinds of raw iron powder having the particle diameter not larger than 50 microns and not larger than 100 microns respectively were prepared and sintered and then treated to oxidize with different temperatures. Temperatures of the first sintering, particle diameters after the sintering and temperatures of the treating to oxidize and apparent densities of 14 kinds of iron powder obtained as above are shown in the following Table.

Developers were made by using said iron powder according to the following prescription and then copying was made by using U-BIX 1500 copier which is sold on the market. The result of the above test in the copying number, the image quality and the background development are also shown in said Table:

| | |
|---|---|
| Developing carrier | 100 parts |
| Toner containing styrene resin, carbon black and nigrosine in the | |

-continued

| | |
|---|---|
| ratio 100:6:4 | 6 parts |

TABLE

| Sample No. | | Particle diameter of material (micron) | First sintering temperature (°C.) | Particle diameter after sintering (micron) | Treating Temperature to oxideze (°C.) | Apparent density | Result of Test copying No. of copy | Background development |
|---|---|---|---|---|---|---|---|---|
| Samples | 1 | not larger than 50 | 950 | 50–200 | 300–370 | 2.18g/cm$^3$ | 20000 | has not arisen |
| | 2 | not larger than 50 | 1100 | " | " | 2.22g/cm$^3$ | " | has not arisen |
| | 3 | not larger than 50 | 950 | " | " | 1.80g/cm$^3$ | " | has not arisen |
| | 4 | not larger than 50 | 950 | " | " | 2.30g/cm$^3$ | " | has not arisen |
| | 5 | not larger than 50 | 850 | " | " | 2.13g/cm$^3$ | 5000 | arose |
| | 6 | not larger than 50 | 1300 | " | " | 3.10g/cm$^3$ | 6000 | " |
| | 7 | not larger than 50 | 950 | " | " | 1.35g/cm$^3$ | 10000 | " |
| Comparative samples | 8 | not larger than 100 | " | " | " | 2.17g/cm$^3$ | 8000 | " |
| | 9 | not larger than 100 | " | " | " | 2.62g/cm$^3$ | 6000 | " |
| | 10 | not larger than 50 | " | not less than 200 | " | 2.95g/cm$^3$ | inferior image quality | |
| | 11 | not larger than 50 | " | not less than 200 | " | 2.80g/cm$^3$ | 3000 | arose |
| | 12 | not larger than 50 | " | 50–200 | 250–280 | 2.01g/cm$^3$ | 7000 | " |
| | 13 | not larger than 50 | " | " | " | 2.70g/cm$^3$ | 4000 | " |
| | 14 | not larger than 50 | " | " | " | 1.80g/cm$^3$ | 4000 | " |

From said Table, it is obvious that the sample iron powder developing carriers in which the sintering condition, the apparent density etc. thereof are adapted for this invention make the superior quality of image and less background development even when each copying number reaches 20,000 sheets. On the contrary, the comparative samples in which the sintering condition, the apparent density etc. thereof are not adapted for the essence of this invention can copy less number by far, and produce the background development or the inferior image quality.

What is claimed is:

1. An iron powder, useful as a developing carrier for developing an electrostatic latent image, having an apparent density of from 1.5 to 2.5 g/cm$^3$ made by the method comprising the steps of: sintering a raw iron powder, that has been ground to a particle size of not larger than 50 microns in diameter, without using any binder agent at a temperature of from 900°–1200° C. to form a sintered body; grinding and classifying said sintered body into an intermediate iron powder having a particle diameter of from 50 to 200 microns; then treating said intermediate iron powder to oxidize it at a temperature of from 300° to 370° C., so that an oxidized film is coated on the surface of the iron powder; and adjusting the resultant iron powder so as to have an apparent density of from 1.5 to 2.5 g/cm$^3$.

2. A developer, for developing an electrostatic latent image, which comprises a toner and an iron powder developing carrier, wherein the iron powder developing carrier has an apparent density of from 1.5 to 2.5 g/cm$^3$, and wherein the iron powder developing carrier is made by the method comprising the steps of: sintering a raw iron powder, that has been ground to a particle size of not larger than 50 microns in diameter, without using any binder agent at a temperature of from 900°–1200° C. to form a sintered body; grinding and classifying said sintered body into an intermediate iron powder having a particle diameter of from 50 to 200 microns; then treating said intermediate iron powder to oxidize it at a temperature of from 300° to 370° C., so that an oxidized film is coated on the surface of the iron powder; and adjusting the resultant iron powder so as to have an apparent density of from 1.5 to 2.5 g/cm$^3$.

* * * * *